US007159742B2

(12) United States Patent
Lee

(10) Patent No.: US 7,159,742 B2
(45) Date of Patent: Jan. 9, 2007

(54) SPOUT ASSEMBLY FOR ENHANCING STANDING FORCE OF FLEXIBLE CONTAINER

(76) Inventor: Jung Min Lee, 1208 Misung Apt. A-dong, 37 Yeoueudo-dong, Youngdungpo-gu, Seoul (KR) 150-010

( * ) Notice: Subject to any disclaimer, the term of this patent is extended or adjusted under 35 U.S.C. 154(b) by 171 days.

(21) Appl. No.: 10/497,758

(22) PCT Filed: Dec. 7, 2002

(86) PCT No.: PCT/KR02/02310

§ 371 (c)(1),
(2), (4) Date: Jun. 4, 2004

(87) PCT Pub. No.: WO03/047993

PCT Pub. Date: Jun. 12, 2003

(65) Prior Publication Data

US 2005/0029290 A1 Feb. 10, 2005

(30) Foreign Application Priority Data

| | | |
|---|---|---|
| Dec. 7, 2001 | (KR) | 10-2001-0079869 |
| Dec. 13, 2001 | (KR) | 10-2001-0084573 |
| Dec. 17, 2001 | (KR) | 10-2001-0086432 |
| Mar. 3, 2002 | (KR) | 10-2002-0012298 |
| Mar. 6, 2002 | (KR) | 10-2002-0013076 |
| May 6, 2002 | (KR) | 10-2002-0025702 |

(51) Int. Cl.
*B65D 35/14* (2006.01)
*B65D 35/28* (2006.01)

(52) U.S. Cl. ..... 222/92; 222/95; 222/173

(58) Field of Classification Search ..... 222/92, 222/95, 105, 173
See application file for complete search history.

(56) References Cited

U.S. PATENT DOCUMENTS

| | | | | |
|---|---|---|---|---|
| 4,978,025 | A * | 12/1990 | Fougeres | 222/105 |
| 5,350,240 | A | 9/1994 | Billman et al. | 383/104 |
| 5,647,511 | A * | 7/1997 | Bond | 222/105 |
| 6,105,821 | A * | 8/2000 | Christine et al. | 222/105 |

FOREIGN PATENT DOCUMENTS

| | | |
|---|---|---|
| JP | 2001270533 | 10/2001 |
| JP | 20011328648 | 11/2001 |
| JP | 2002053138 | 2/2002 |
| JP | 2002154551 | 5/2002 |
| JP | 2002154552 | 5/2002 |

* cited by examiner

*Primary Examiner*—Joseph A. Kaufman
(74) *Attorney, Agent, or Firm*—Norris McLaughlin & Marcus PA

(57) ABSTRACT

A spout assembly for enhancing self-standing force of a flexible container includes a fitting portion for attaching on a portion of the flexible container, and a supporting member assembled on or integrally formed on the fitting portion and extending to contact at least more than one portion of front, rear, bottom and top portions of the container, thereby maintaining a predetermined shape of the flexible container.

10 Claims, 19 Drawing Sheets

SPOUT ASSEMBLY FOR ENHANCING STANDING FORCE OF FLEXIBLE CONTAINER

This application is a 371 of PCT/KR02/02310, filed Dec. 7, 2002.

TECHNICAL FIELD

The present invention relates to a spout assembly and, more particularly, to a spout assembly that is designed enhancing the self-standing force of a pouch container.

BACKGROUND ART

Generally, in recent years, a pouch container has been widely used for beverage for its transportation and cost advantages.

However, such a pouch container has a problem that the self-standing ability is deteriorated due to its flexibility.

Although a self-standing pouch container such as a standing type pouch and a M-shaped pouch container has been proposed, since it is designed not to provide a definite-straight standing state even when the content such as beverage or other liquids is filled therein, when displaying the same, the aesthetic aspect of the pouch container is deteriorated due to its deformation in part.

Furthermore, when the pouch container is employed for a pump dispenser container, since additional rigid supporting case is required, it is a troublesome for a user while increasing the costs.

DISCLOSURE OF INVENTION

Therefore, the present invention has been made in an effort to solve the above-described problems of the prior art.

It is a first objective of the present invention to provide a spout assembly that enhances the self-standing state of the pouch, thereby improving the outer appearance.

It is a second objective of the present invention to provide a spout assembly for a pouch container that can allow the pouch container to be used as a container for a pump dispenser by providing supporting force with respect to vertical depressing force applied by pumping force.

To achieve the above objectives, the present invention provides a spout assembly.

BEST MODE FOR CARRYING OUT THE INVENTION

Preferred embodiments of the present invention will be described more in detail hereinafter in conjunction with the accompanying drawings.

Figure 1:
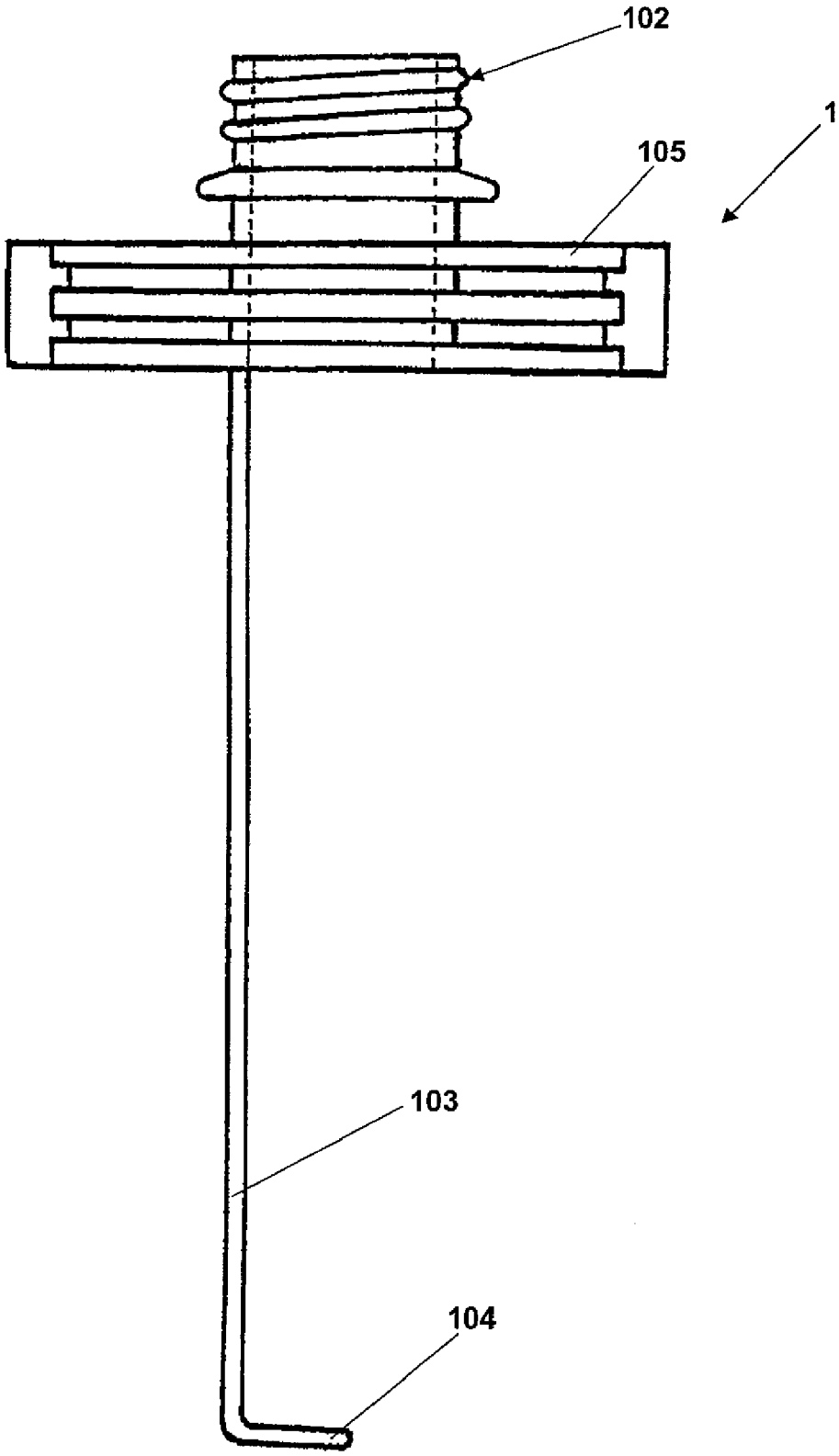
FIG. 1 is a perspective view of a spout assembly according to a first embodiment of the present invention.

FIG. 1 shows a spout assembly according to a first embodiment of the present invention.

As shown in the drawing, the spout assembly 1 of this embodiment comprises a spouting portion 102, a fitting portion 105 integrally extending downward from the spouting portion 102, the fitting portion 105 being attached on a pouch body, and a support 103 extending from the fitting portion 105 to a bottom of the pouch body.

The support 103 is provided at its lower end with a supporting stable part 104 for enhancing the self-standing of the pouch body and preventing the bottom of the pouch body from being damaged, the supporting stable part 104 is right-angled at the lower end of the support 103 to be parallel with the bottom of the pouch body.

Figure 2:
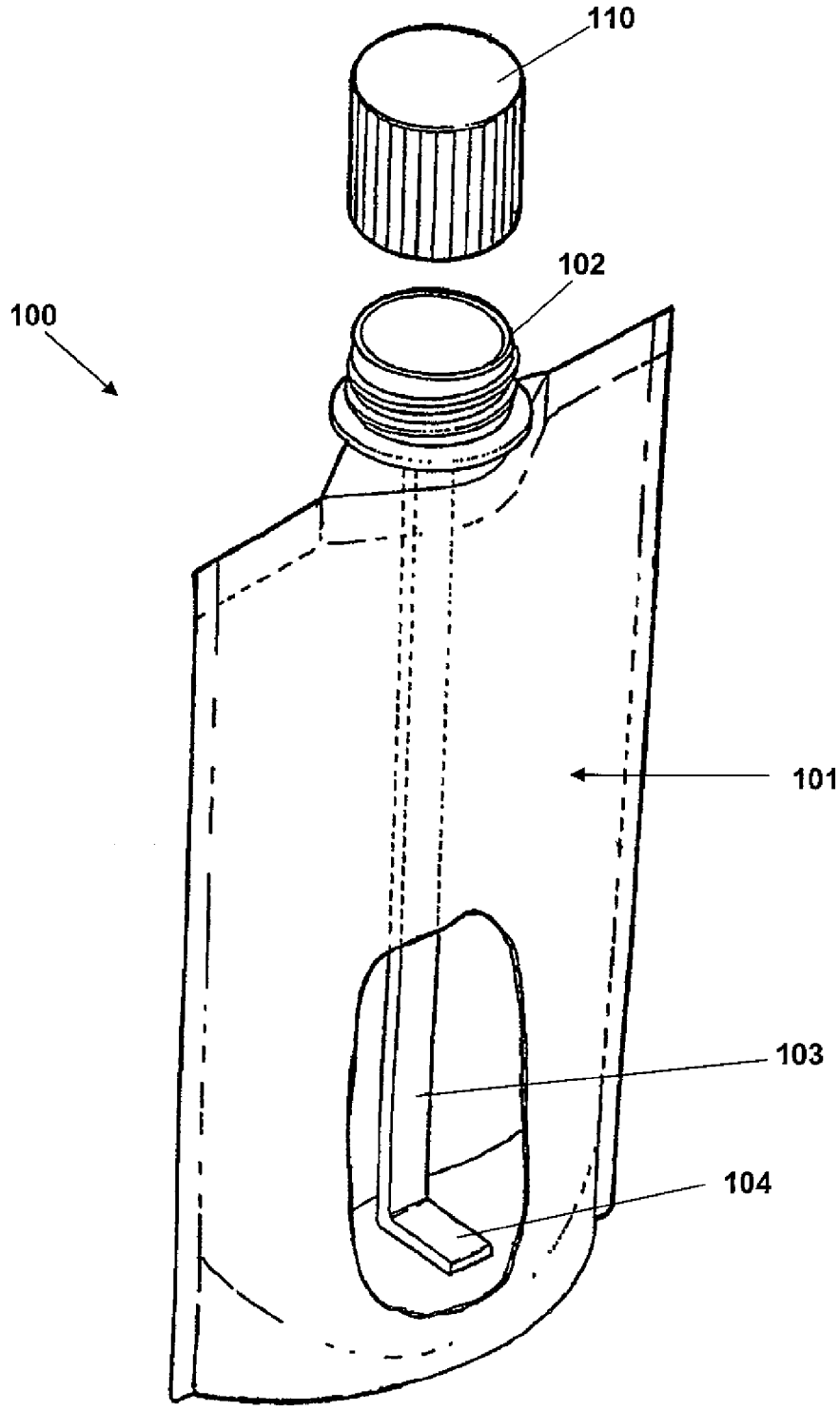
FIG. 2 is a perspective view illustrating an example where a spout assembly according to a first embodiment of the present invention is employed to a standing-type pouch container.

FIG. 2 shows an example where the spout assembly of the first embodiment is employed to a standing-type pouch container.

As shown in the drawing, the pouch container comprises a pouch main body provided at its upper end with a spout fitting portion where the fitting portion of the spout assembly 1 is fitted or attached. The support 103 extends to the inner bottom of the main body 101 such that the supporting stable part 104 contacts the inner bottom of the main body 101 in parallel.

In addition, the spouting portion 102 is designed to maintain the seal by a cap 110.

Figure 3:
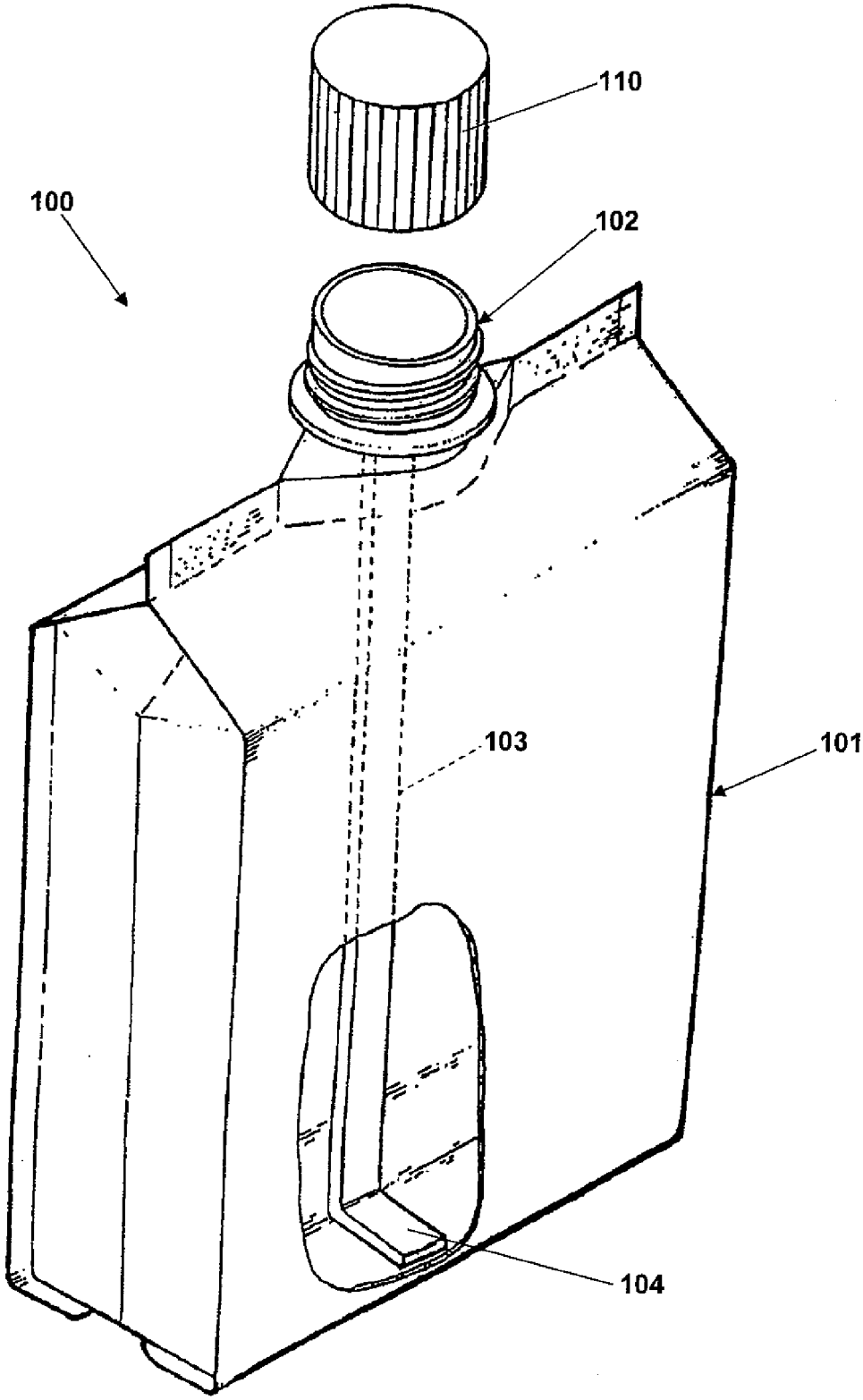
FIG. 3 is a perspective view illustrating an example where a spout assembly according to a first embodiment of the present invention is employed to a M-type pouch container.

FIG. 3 shows an example where the spout assembly of the first embodiment is employed to a M-type pouch container.

Since this embodiment is identical to that shown in FIG. 2 except for the structure of the pouch body, the detailed description thereof will be omitted herein.

Figure 4:
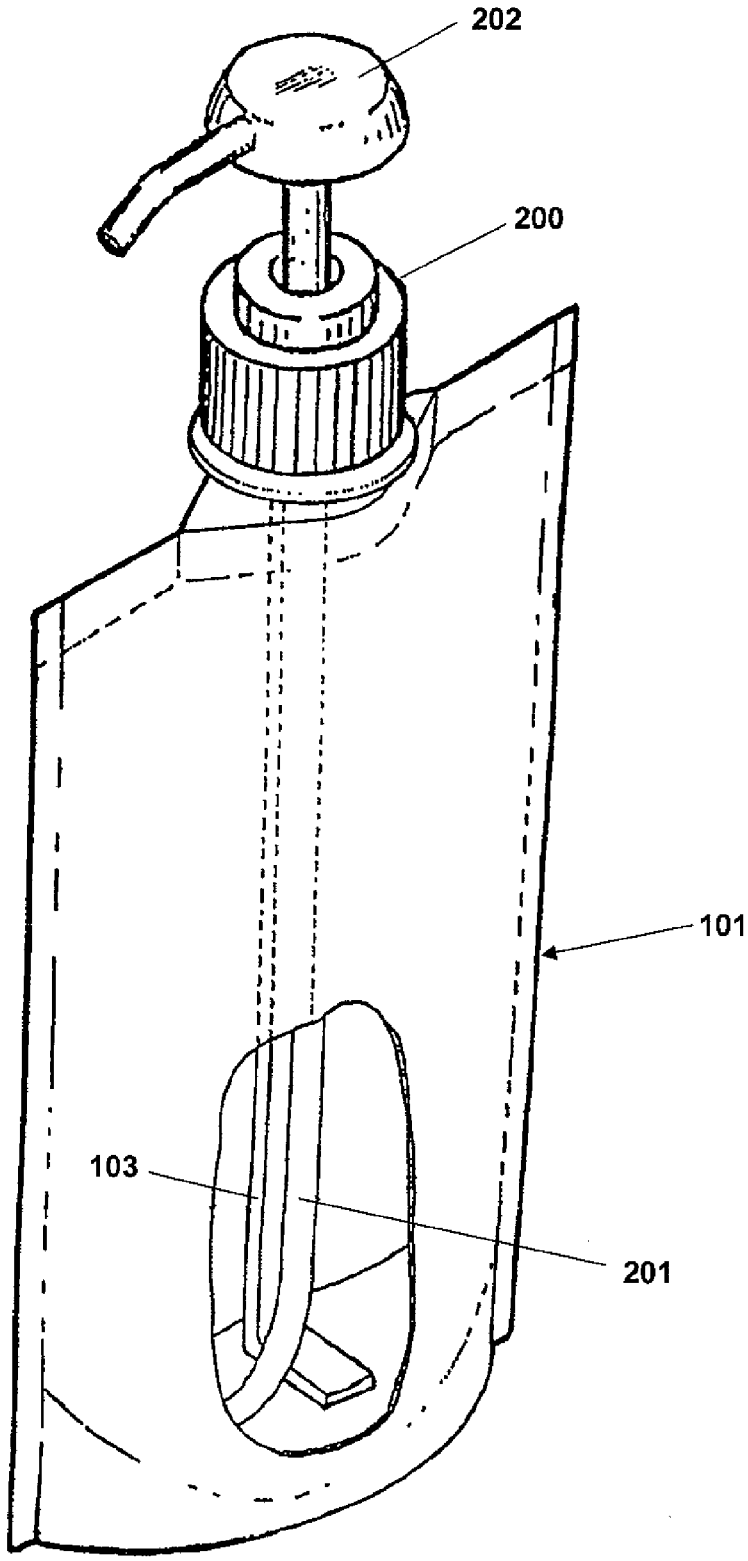
FIG. 4 is a perspective illustrating an example where a spout assembly according to a first embodiment of the present invention is employed to a dispenser pouch container.

FIG. 4 shows an example where the spout assembly of the first embodiment is employed to a dispenser pouch container.

As shown in the drawing, a pump dispenser assembly composed of a pump 200 and a button 202 can be associated with the spout assembly 1.

In this case, even when the button is depressed to operate the pump 200, the depressing force is supported on the support 103. Therefore, the contents can be discharged without compressing the pouch main body even there is no special supporting cover.

The support stable part 104 of the support 103 can be varied in a variety of shapes, and the support 103 can be formed of more than two rods.

Figure 5:
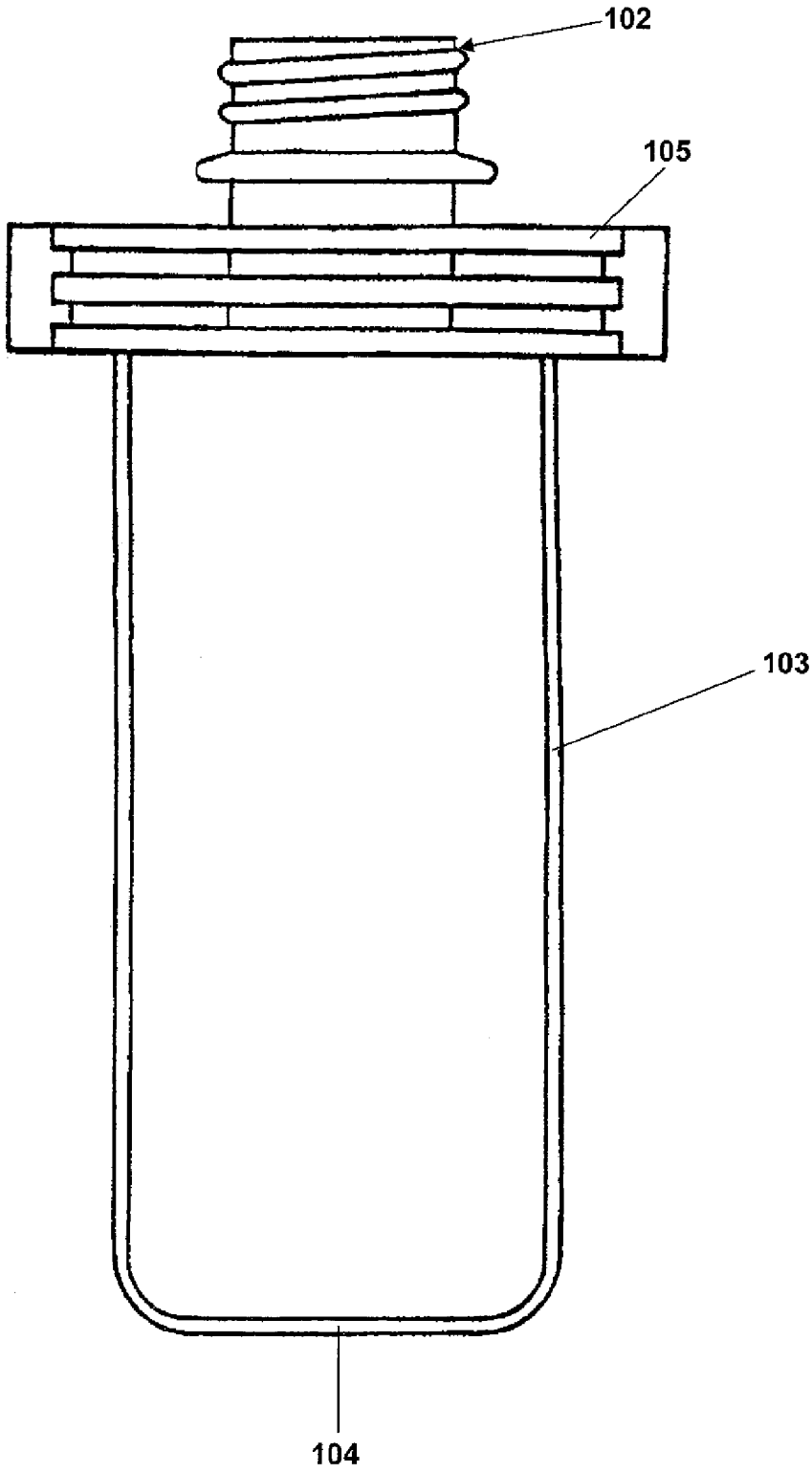
FIG. 5 is a perspective view of a spout assembly according to a second embodiment of the present invention.

FIG. 5 shows a spout assembly according to a second embodiment of the present invention.

As shown in the drawing, the support 103 is formed of at least two members, and the lower ends of the members are joined together to define a support stable part 104.

Figure 6:
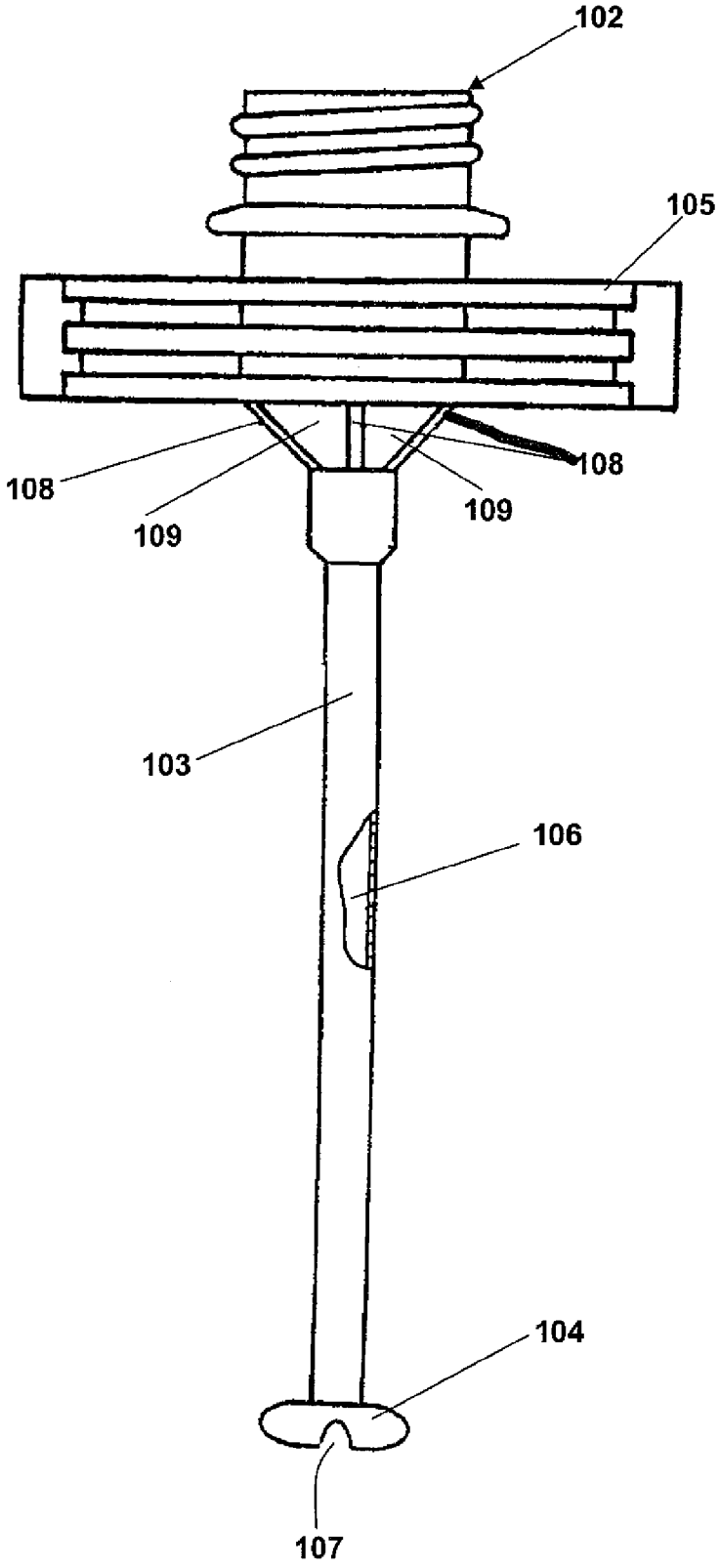
FIG. 6 is a perspective view of a spout assembly according to a third embodiment of the present invention.

FIG. 6 shows a spout assembly according to a third embodiment of the present invention.

A support 103 is provided along its longitudinal axis with a spouting hole 106 and at its lower end with support stable part having a bottom spouting hole 107 communicating with the spouting hole 106. The upper end of the support 103 is integrally connected to the bottom of a fitting portion 105 by plural connecting members 108 defining side openings 10.

The spout assembly of this embodiment has an advantage that, when it is employed to a dispenser pouch container, the spouting holes 106 and 107 function as a spouting tube of a dispenser.

Figure 7:
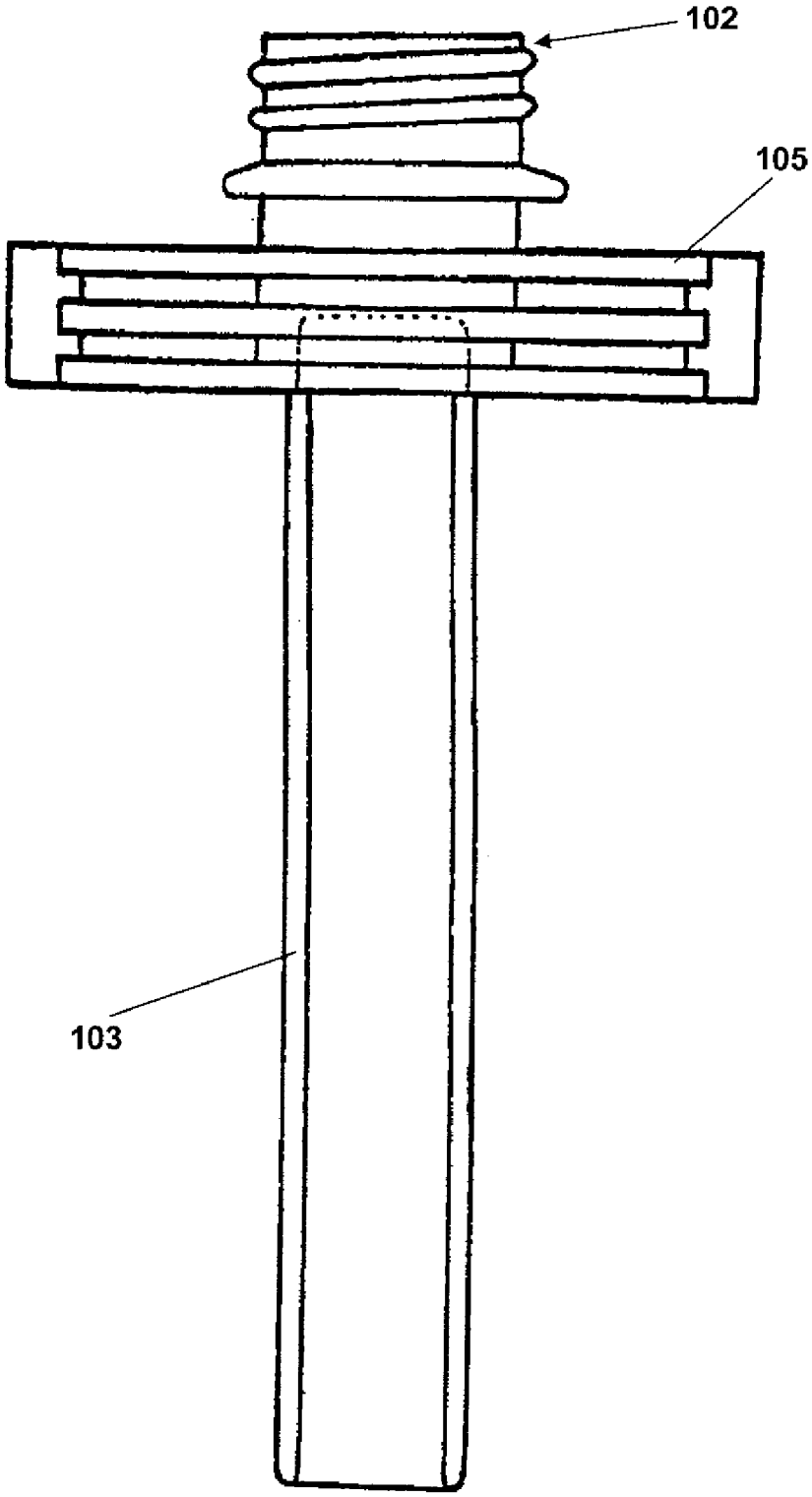
FIG. 7 is a perspective view of a spout assembly according to a fourth embodiment of the present invention.

In addition, as shown in a fourth embodiment of FIG. 7, the support 103 can be separately manufactured and then assembled on a lower portion of a spouting portion 105.

Figure 8:
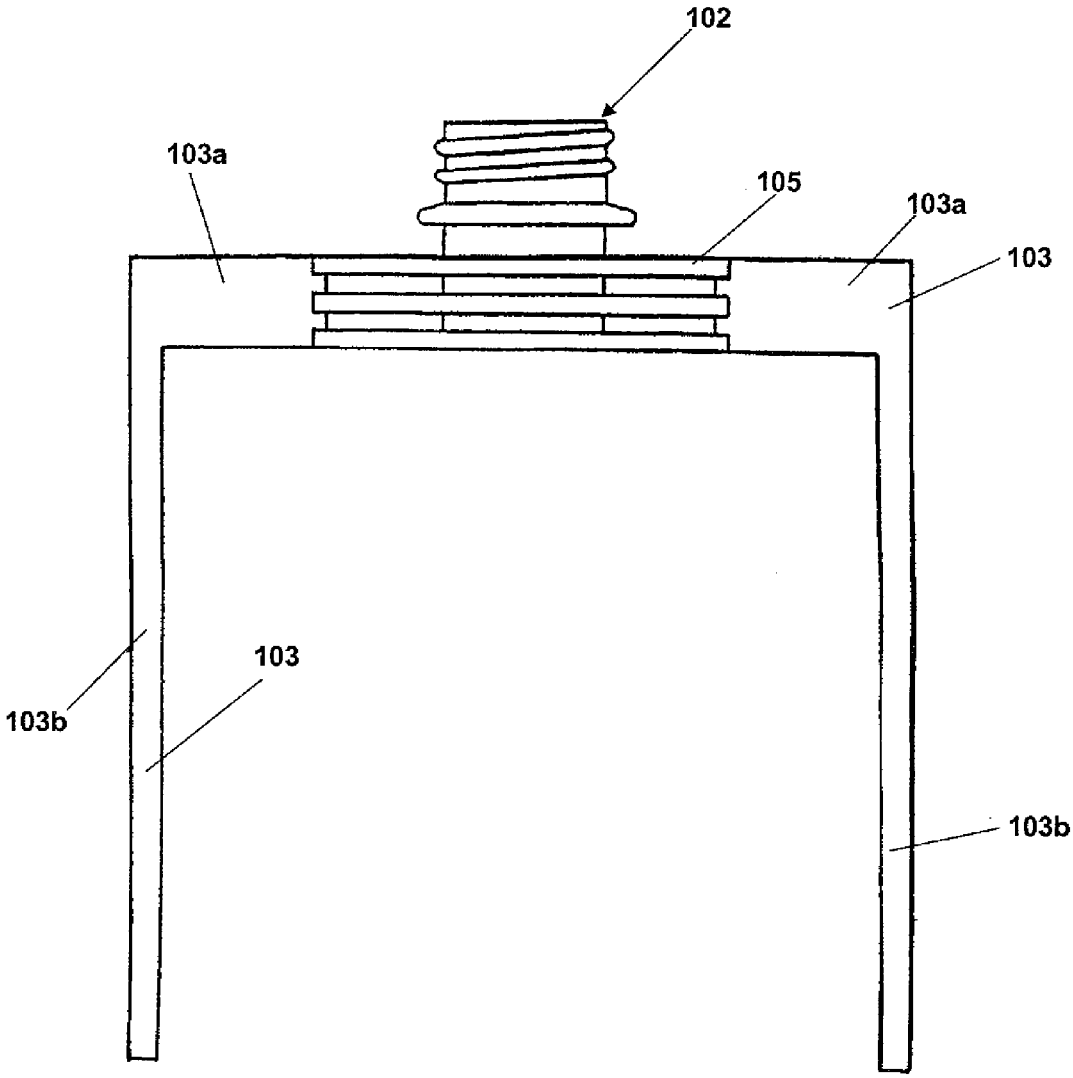
FIG. 8 is a perspective view of a spout assembly according to a fifth embodiment of the present invention.

FIG. 8 shows a fifth embodiment of the present invention. A support of a spout assembly of this embodiment comprises an upper supporting portion 103*a* extending from opposite side ends of a fitting portion 102 and a pouch side supporting portion 103*b* extending downward from outer ends of the upper supporting portion 103*a*.

Figure 9:
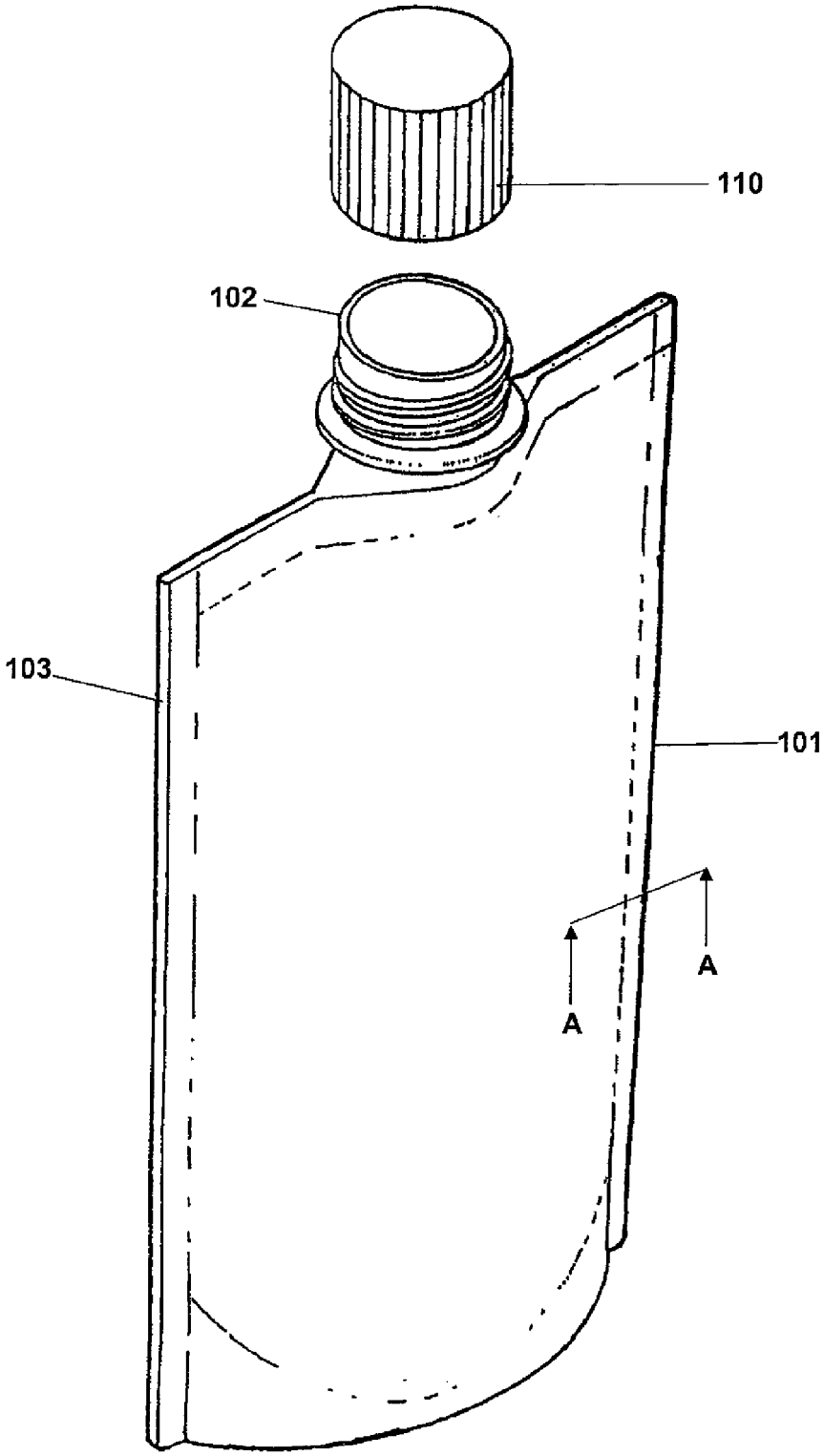
FIG. 9 is a perspective view illustrating an example where a spout assembly according to a fifth embodiment of the present invention is employed to a pouch container.

FIG. 9 shows an example where the support depicted in FIG. 8 is employed to a pouch container. As shown in the drawing, the upper supporting portion 103*a* supports the upper end of the container body 101, and the pouch side supporting portion 103*b* supports both sides of the body 101, thereby providing more improved self-standing force to the pouch container.

Figure 10A:
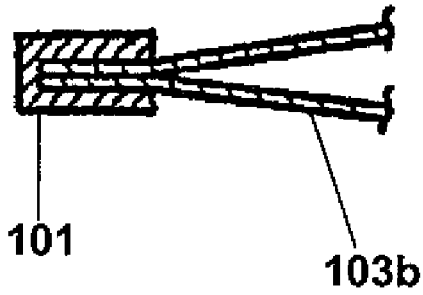
FIG. 10*a* is a sectional view taken along a line A—A of FIG. 9.
Figure 10B:
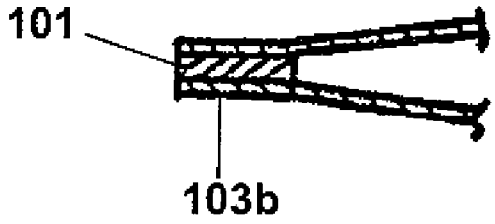
FIG. 10*b* is a sectional view illustrating another example similar to FIG. 10*a;*

Particularly, as shown in FIG. 10*a*, the support is located on the inner upper ends and inner opposite sides of the container main body 101 so that it can be possible that the support is integrally formed with the container main body 101 through an injection in-molding process. Alternatively, as shown in FIG. 10*b*, the support can be located on the outer upper ends and outer opposite sides of the container main body 101 and also can be integrally formed with the container main body 101 through the injection in-molding process.

Figure 11:
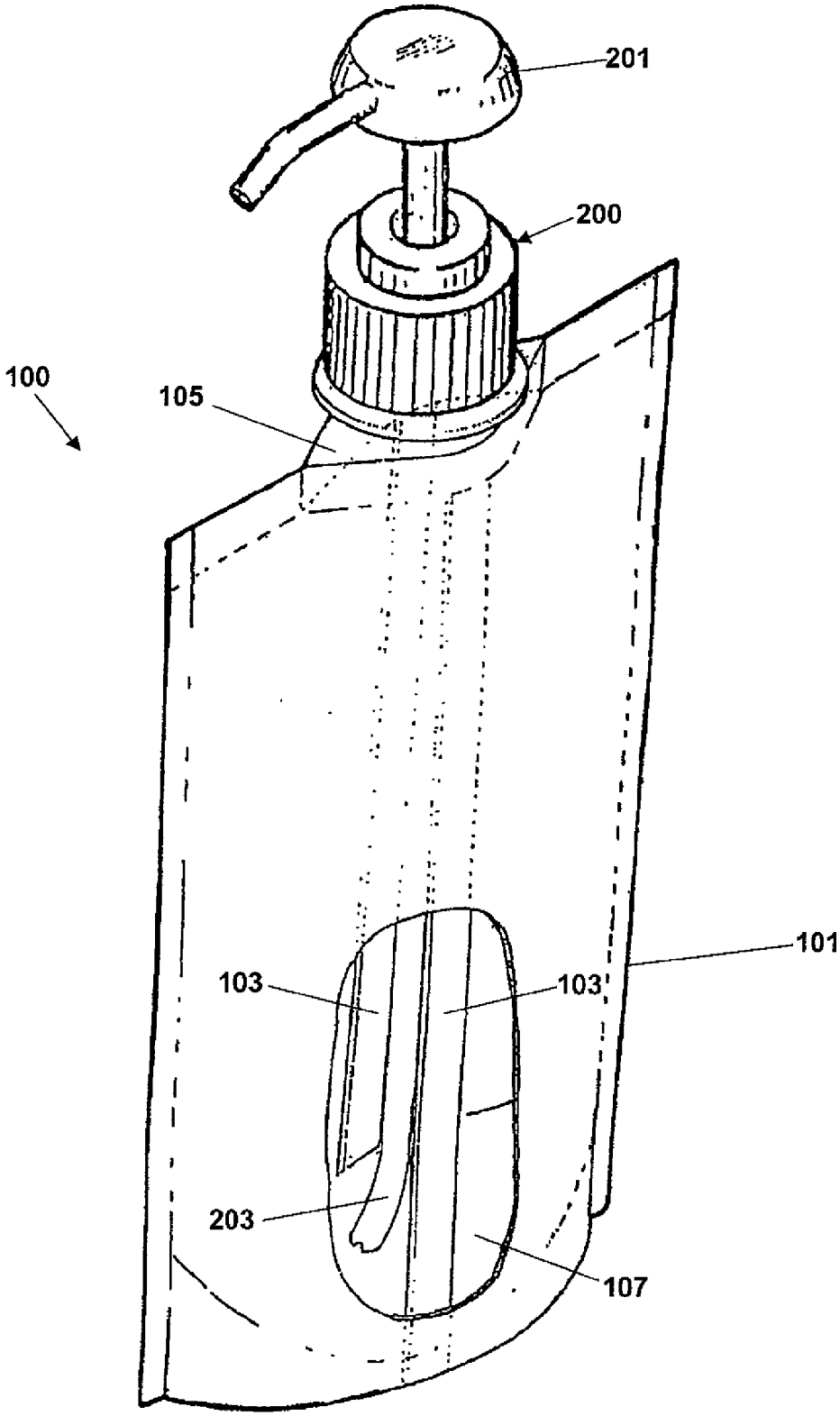
FIG. 11 is a partly broken perspective view illustrating an example where a spout assembly according to a sixth embodiment of the present invention is employed to a pouch container.
Figure 12:
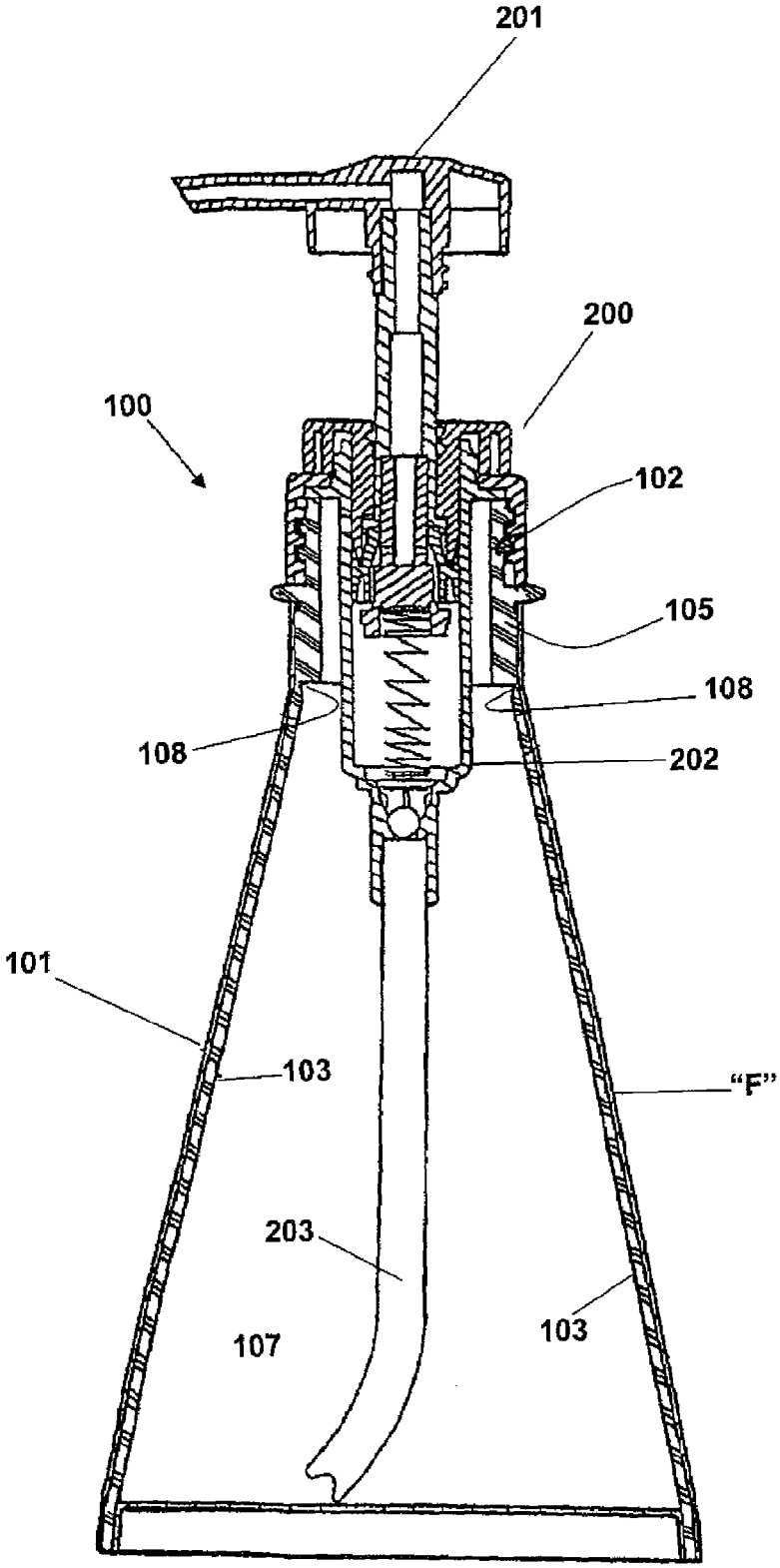
FIG. 12 is a sectional view of FIG. 11.

FIGS. 11 and 12 show an example where a spout assembly according to a sixth embodiment of the present invention is employed to a dispenser pouch container.

As shown in the drawings, a dispenser pouch container 100 comprises a container main body 101, and a spout assembly having a fitting portion 105 attached on the container main body 101 and a spouting portion 102. A conventional pump assembly 200 is assembled with the spouting portion 102 of the spout assembly.

The pouch main body 101 is supported for its self-standing force by a support 103. The support 103 is integrally connected to the bottom of the fitting portion 105 through an elastic connecting portion 108. The support 103 extends to sealing ends of the bottom 107 of the pouch main body.

In addition, it is preferable that the support 103 is designed contacting the inner surface of the pouch main body F (see FIG. 12).

Accordingly, from a state shown in FIG. 11, when the pump assembly 200 is operated by depressing the button 201, the contents absorbed into the spouting tube 203 is spouted out of the container.

In the course of the above, even when depressing force is applied to the button 201, the flexible pouch main body 101 is not deformed by the support 103 extending to the bottom of the main body 101.

In addition, since the support 103 is connected by the elastic connecting portion 108, even when the support 103 is depressed, the support 103 gets to return to its initial position by the elastic connecting portion 108, thereby maintaining the main body stretched.

Figure 13:
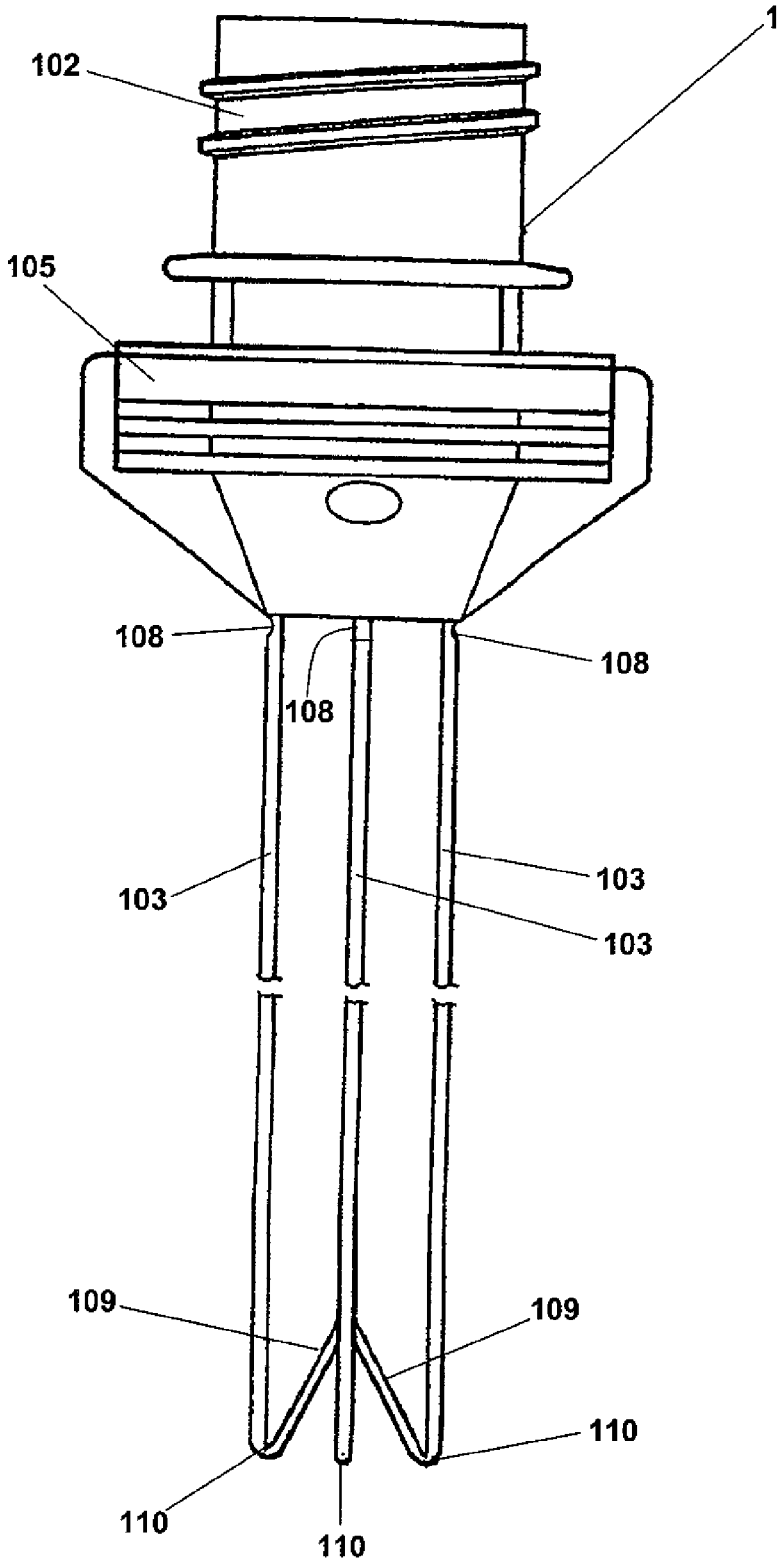
FIG. 13 is a front view of a spout assembly according to a seventh embodiment of the present invention.

FIG. 13 shows a spout assembly according to a seventh embodiment of the present invention.

As shown in the drawing, the spout assembly 1 comprises a fitting portion 105 for attaching on a pouch main body and a spouting portion 102 formed on the fitting portion 105. The spouting portion 102 is designed such that a conventional cap or a dispenser can be coupled thereon. At least one support 103 is formed extending from the fitting portion 105. A connecting portion between the support 103 and the fitting portion 105 is formed in an elastic connecting portion 108 so that the support 103 can be widened outwardly when a pump dispenser is assembled with the spout assembly. A sub-support 109 is integrally coupled to a lower end of the support 103 by a hinge portion 110. Therefore, when the pump dispenser is assembled with the spout assembly 1, the support 103 is pushed outwardly by the supportable spout tube of the pump dispenser and the sub-support 109 stably contacts the bottom of the container.

Figure 14:
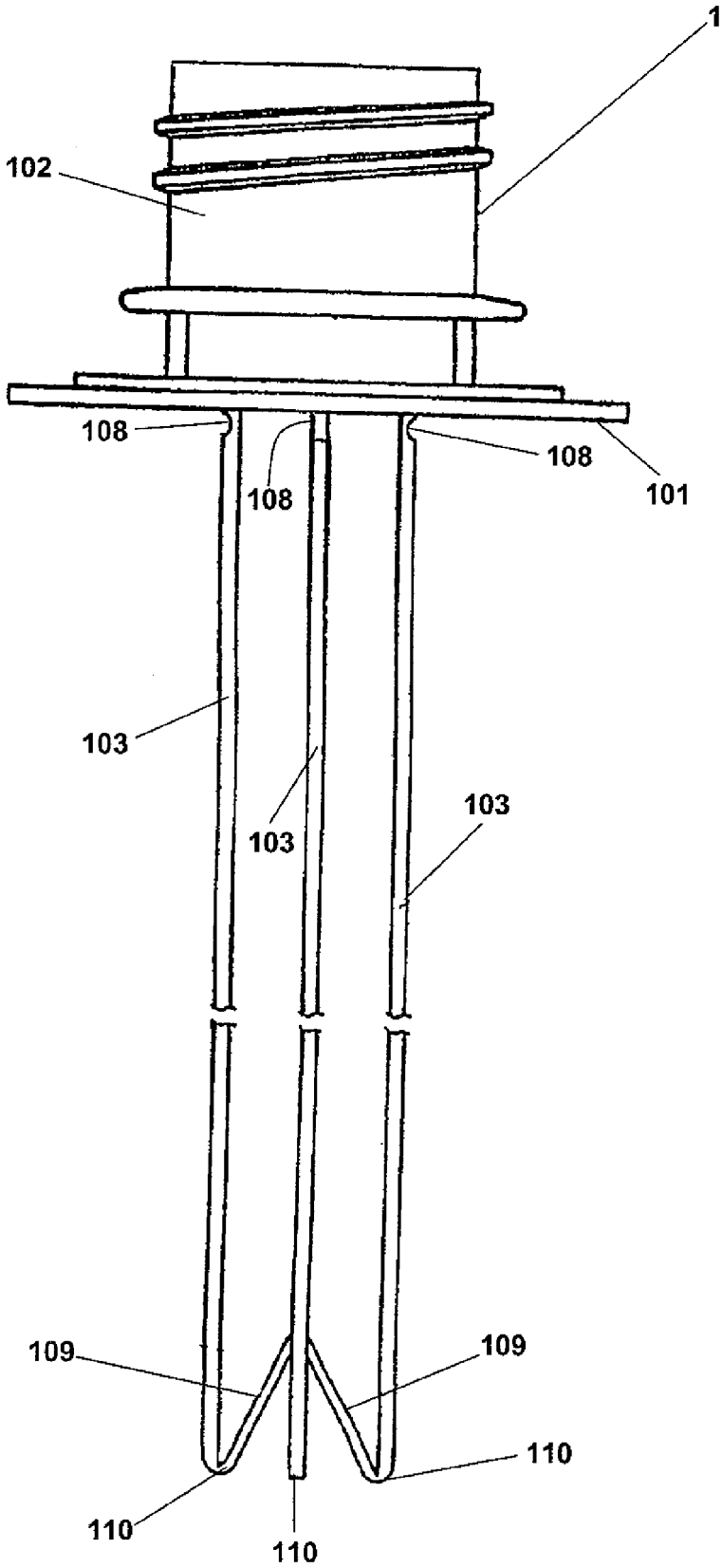
FIG. 14 is a front view of a spout assembly according to an eighth embodiment of the present invention.
Figure 15:
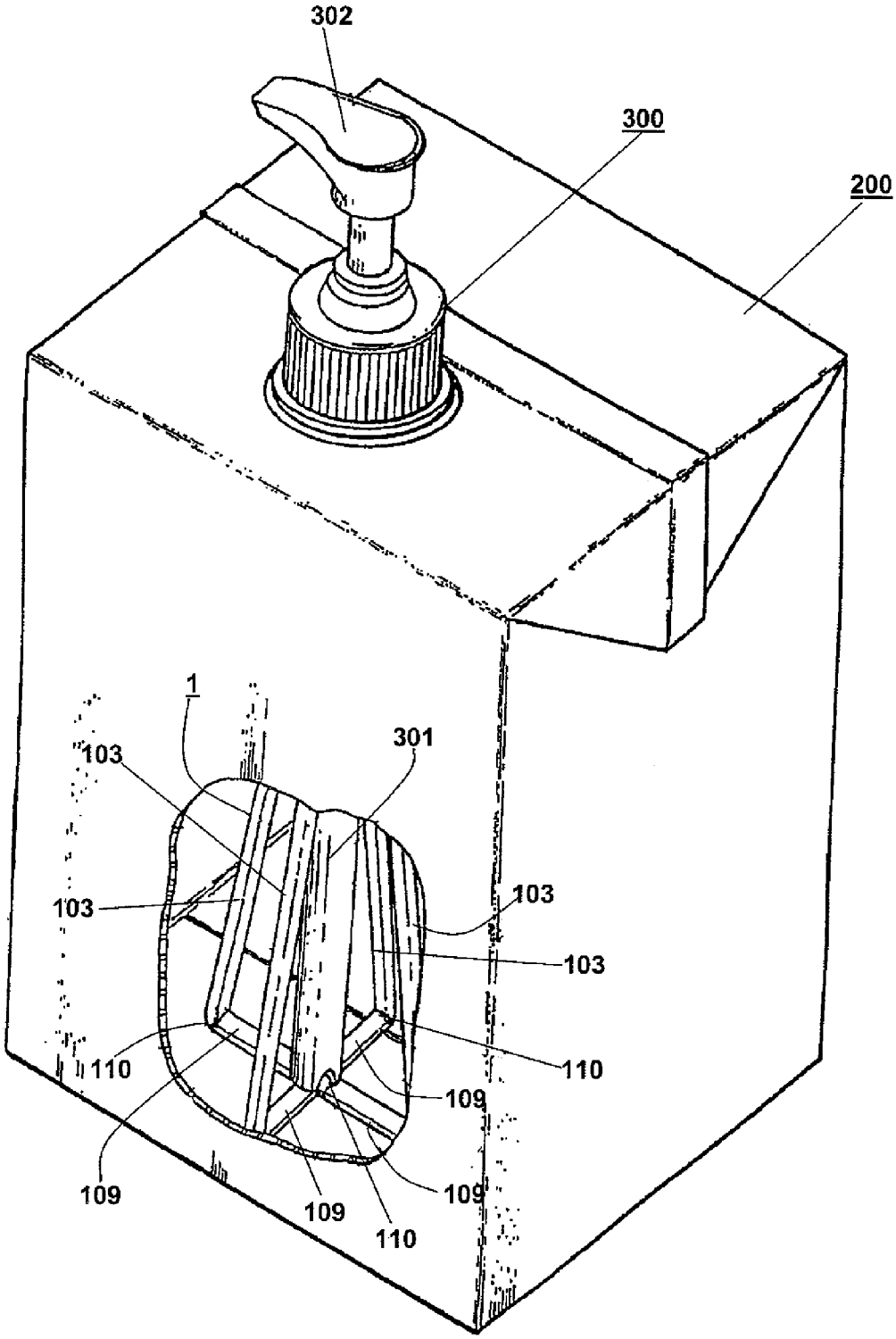
FIG. 15 is a perspective view illustrating an example where a spout assembly according to an eighth embodiment of the present invention is employed to a rectangular paper pack.

FIG. 14 shows a front view of a spout assembly according to an eighth embodiment of the present invention. This embodiment is identical to the seventh embodiment except that the fitting portion 101 is designed to be attached on a top surface of the container such as a carton pack as shown in FIG. 15.

That is, as shown in the drawings, the sub-support 109 is disposed horizontally by the supportable spout tube 301 of the pump dispenser 300 while widening the support 103 at a predetermined angle, thereby stably supporting the carton pack.

In the above-described seventh and eighth embodiments, since the support is widened at a predetermined angle, the carton pack 200 can maintain its shape even when depressing force is applied to a button 302 of the pump dispenser 300.

Figure 16:
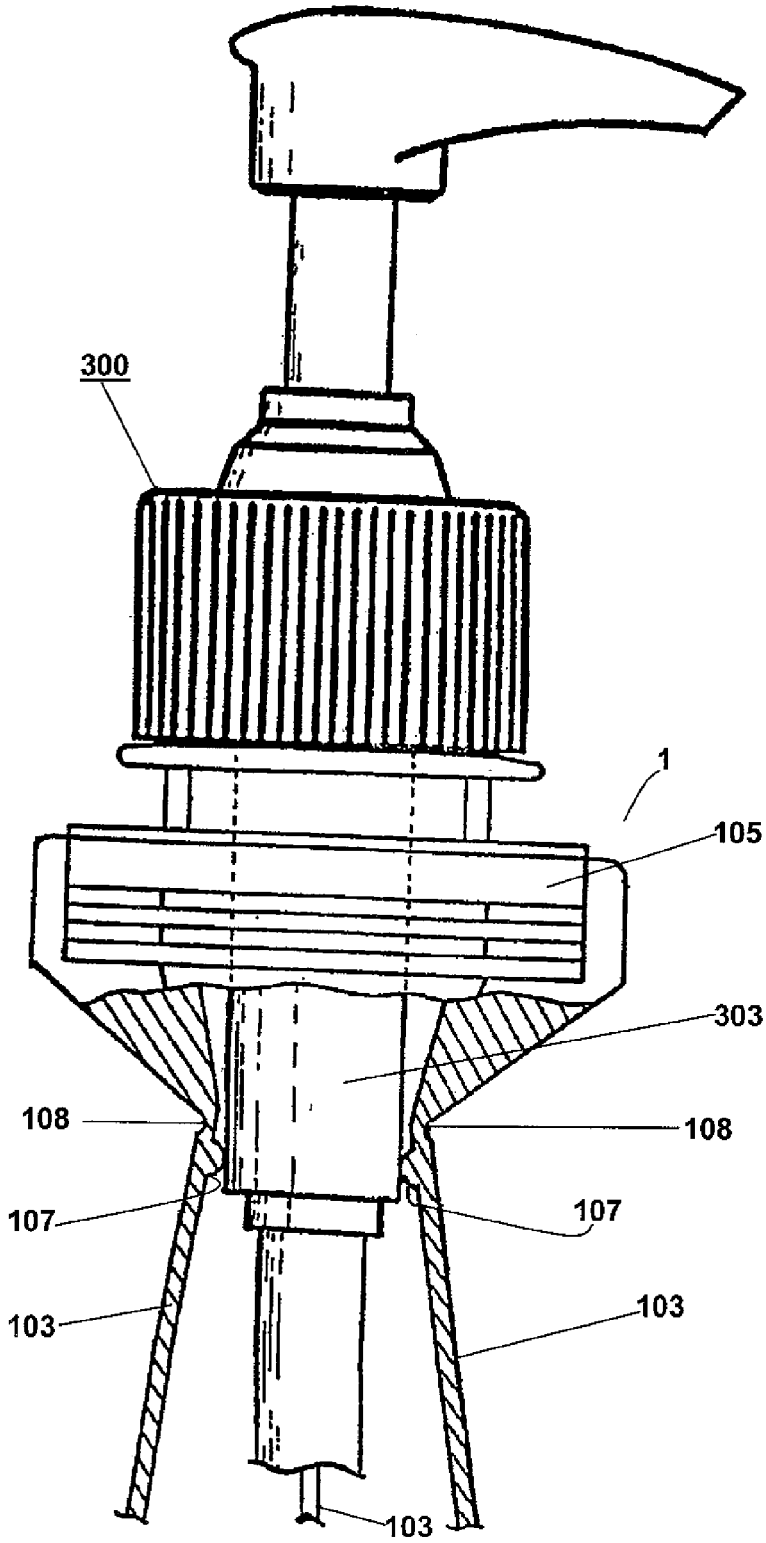
FIG. 16 is a schematic front view of a spout assembly according to a ninth embodiment of the present invention.

FIG. 16 shows a spout assembly according a ninth embodiment of the present invention. This embodiment is similar to the seventh embodiment except that a support 103 is widened outward by a dispenser housing 303 when the pump dispenser 300 is coupled on the spout assembly. That is, a 15 projection 107 is formed on an inner surface of the support under the elastic connecting portion 108. The housing 303 pushes the projection 107 while being inserted into the spout assembly 1.

Figure 17:
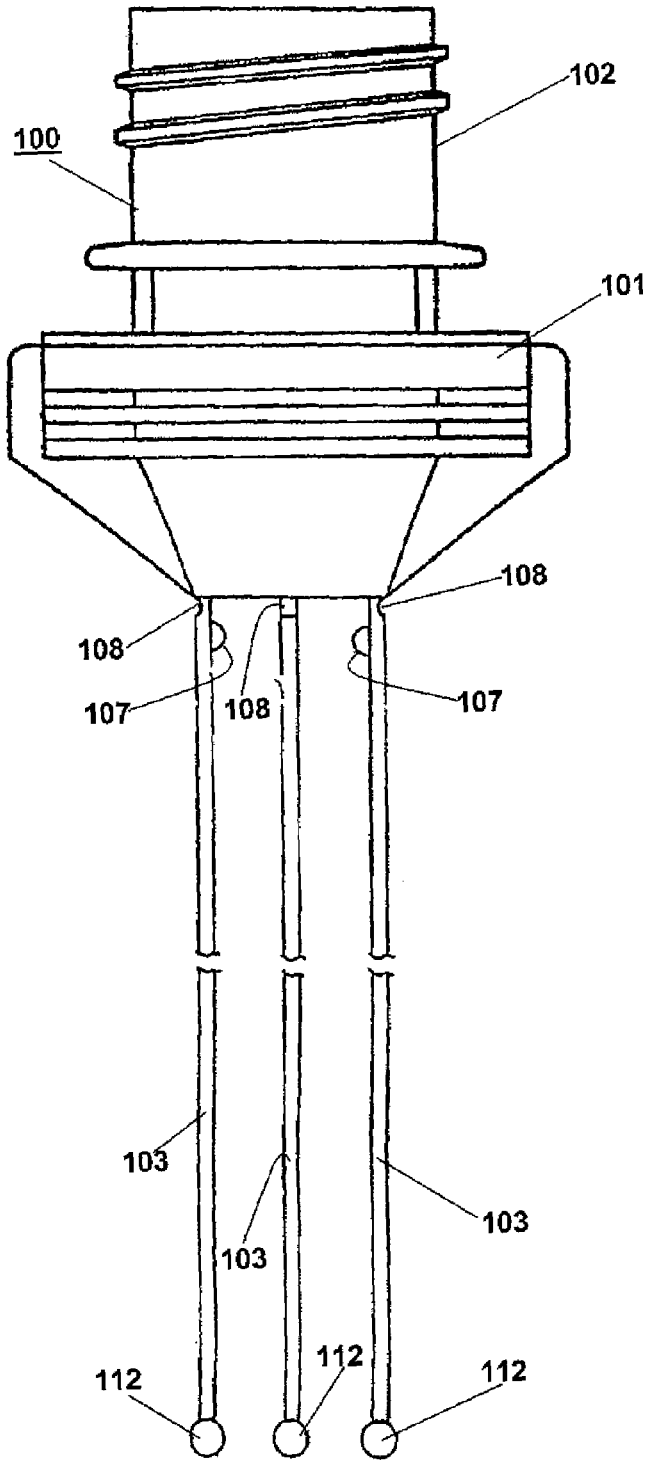
FIG. 17 is a front view of a spout assembly according to a tenth embodiment of the present invention.

FIG. 17 shows a spout assembly according to a tenth embodiment of the present invention. This embodiment is also similar to the seventh embodiment except that a projection 107 is formed under the elastic connecting portion 108 and a bottom-protecting portion 112 is formed on a lower end of the support 103. The bottom-protecting portion 112 is formed in a smooth curved surface.

Figure 18:
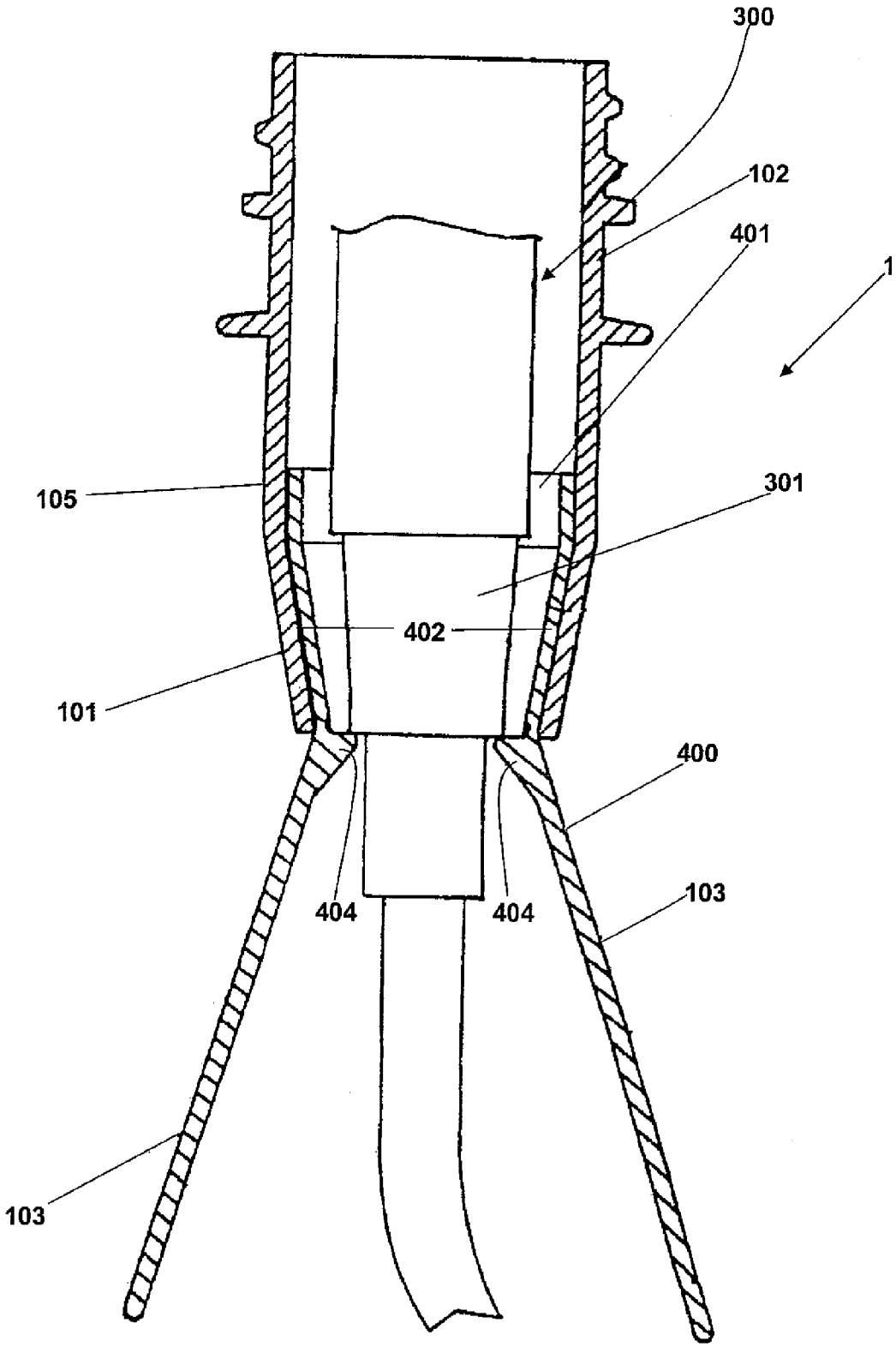
FIG. 18 is a sectional view of a spout assembly according to an eleventh embodiment of the present invention.
Figure 19:
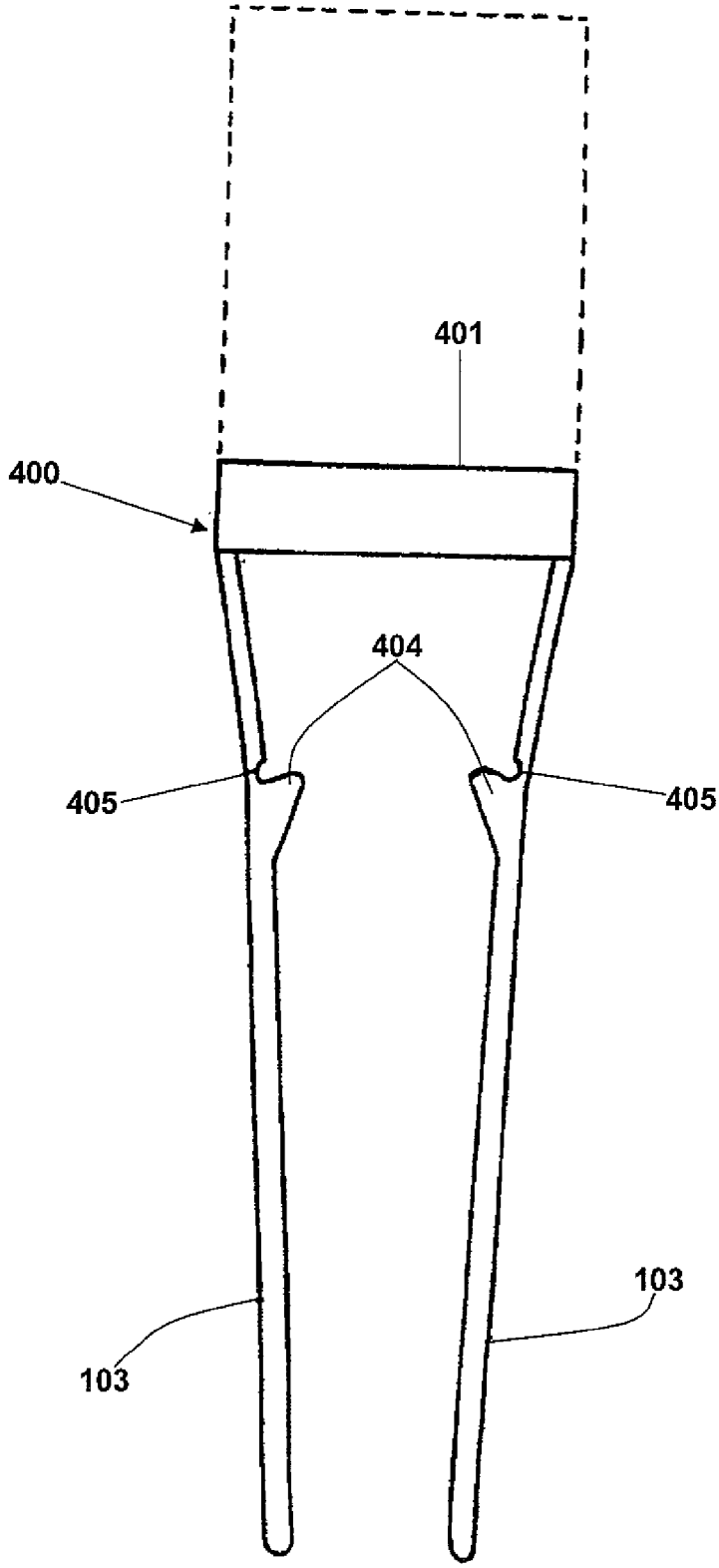
FIG. 19 is a front view illustrating a supporting portion of a spout assembly depicted in FIG. 18.

FIGS. 18 and 19 show a spout assembly according to an eleventh embodiment of the present invention.

In this embodiment, the spout assembly 1 comprises a fitting portion 105 for attaching on the pouch container and a spout portion 102 extending upwardly from the fitting portion 105. A separate closure or a dispenser assembly is associated with the spout portion 102.

A supporting member 400 is assembled on an inner wall of the fitting portion 105.

The supporting member 400, as shown in FIG. 19, comprises a movable supporting frame 401, a fixing body 402 extending downward from the movable supporting frame 401, the fixing body 402 being hooked on the fixing frame 101 integrally formed under the fitting portion 105, and a supporting legs 103 integrally formed under the fixing body 402.

The supporting legs 103 are integrally connected to the fixing body 402 by a hinge-connecting portion 405. A projection is formed on the supporting legs 103 under the hinge-connecting portion 405.

It is preferable that more than two supporting legs that can be widened outwardly in a radial direction are provided.

When the pump dispenser 300 is assembled on the spouting portion 102, the supporting member 400 moves downward by the housing 301 of the pump dispenser 300 and then stops when the fixing body 402 contacts the fixing frame 101.

From this state, when the pump dispenser 300 is moved further downwards, the housing 301 pushes the projection 404 to allow the support legs 103 to be widened (see FIG. 18).

As described above, the self-standing force of the pouch container is further enhanced, improving the display effect when the pouch container is used for beverage products. In addition, since the pouch container is designed such that it is not deformed even when a vertical depressing force is applied thereto, it can be used by being associated with a pump dispenser.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

For example, the container to which the inventive spout assembly is not limited to the pouch. That is, the container can be selected from any flexible material such as carton pack

INDUSTRIAL APPLICABILITY

As described above, the inventive spout assembly can be used for a beverage container or a pump dispenser flexible container.

The invention claimed is:

1. A spout assembly for enhancing self-standing force of a flexible container, the spout assembly comprising:

a fitting portion for attaching on a portion of the flexible container, the flexible container including a bottom portion and at least one side portion;

a supporting member coupled to the fitting portion through an elastic connecting portion, wherein the supporting member extends from the fitting portion to contact the bottom portion of the container, wherein the supporting member is in an initial position when no force is applied to the supporting member, and wherein, when a force in the direction of the bottom portion of the container is applied from the fitting portion to the supporting member, the supporting member moves outwardly in the direction of the side portion of the container, and when the force is removed, the supporting member returns to the initial position, thereby maintaining a predetermined shape of the flexible container.

2. A spout assembly of claim 1, wherein the flexible container is selected from the group consisting of a standing pouch, a M-type pouch and a carton pack.

3. A spout assembly of claim 1, wherein the supporting member comprises a supporting tube provided with a spouting hole.

4. A spout assembly of claim 1, wherein the supporting member is separately prepared and assembled on an inner wall of the fitting portion.

5. A spout assembly of claim 1, wherein the supporting member comprises at least two supporting legs extending from the fitting portion to contact an inner wall of the container.

6. A spout assembly of claim 1, wherein the supporting member comprises at least two supporting legs extending from the fitting portion to the bottom of the container.

7. A spout assembly of claim 6, further comprising:

a sub-supporting leg coupled to a lower end of each of the supporting legs through a hinge connection, wherein the sub-supporting legs extend upwardly from the bottom of the container at a predetermined angle so that the supporting legs are moveable toward and away from each other.

8. A spout assembly of claim 1, wherein the fitting portion has a horizontally extending bottom for coupling to on a flat top surface of a container.

9. A spout assembly of claim 6, wherein the supporting legs are provided at their lower ends with a container bottom protecting portion having a smooth curve.

10. A spout assembly for enhancing self-standing force of a flexible container, the spout assembly comprising:

a fitting portion for attaching on a portion of the flexible container, the flexible container including a bottom portion and at least one side portion;

a supporting member coupled to the fitting portion, wherein the supporting member comprises:

a movable supporting frame coupled to and movable on an inner wall of the filling portion, a fixing member coupled to and extending from the movable supporting frame downwardly toward the bottom portion of the container, the fixing member being fixed on a fixing frame formed at a lower portion of the fitting portion, and at least two supporting legs extending, from the fixing member downwardly toward the bottom portion of the container, wherein each of the supporting legs is connected to the fixing member by a hinge and includes a projection, and wherein the supporting legs are in an initial position when no force is applied to the supporting legs, and wherein, when the movable support frame is moved in the direction of the bottom of the container, the movable support frame contacts the fixing member so as to apply a force in the direction of the bottom of the container onto the projections of the supporting legs causing the supporting legs to move outwardly in the direction of the side portion of the container, and wherein when the force is removed, the supporting legs return to the initial position, thereby maintaining a predetermined shape of the flexible container.

* * * * *